United States Patent [19]

Watanabe et al.

[11] Patent Number: 4,564,462

[45] Date of Patent: Jan. 14, 1986

[54] MENTHOL SOAP

[75] Inventors: Hajime Watanabe, Machida; Yoshio Tanaka, Tokyo; Seiichi Abe, Yokohama, all of Japan

[73] Assignees: Takasago Perfumery Co., Ltd., Tokyo; Sunstar K.K., Takatsuki, both of Japan

[21] Appl. No.: 618,462

[22] Filed: Jun. 8, 1984

[30] Foreign Application Priority Data

Jun. 23, 1983 [JP] Japan ..... 58-111905

[51] Int. Cl.[4] ..... C11D 17/00

[52] U.S. Cl. ..... 252/134; 252/108; 252/118; 252/122; 252/132; 424/69

[58] Field of Search ..... 252/108, 118, 122, 132, 252/134, DIG. 16; 424/69, 73, 74

[56] References Cited

U.S. PATENT DOCUMENTS

| | | | |
|---|---|---|---|
| 1,991,501 | 2/1935 | Gettemuller | 252/132 |
| 4,014,807 | 3/1977 | Werner et al. | 252/134 |
| 4,169,067 | 9/1979 | Joshi | 252/DIG. 16 |
| 4,265,778 | 5/1981 | Sonnenstein | 252/132 |
| 4,288,341 | 9/1981 | Hooper et al. | 252/108 |

FOREIGN PATENT DOCUMENTS

| | | | |
|---|---|---|---|
| 2075044 | 11/1981 | United Kingdom | 252/132 |
| 2068997 | 8/1981 | United Kingdom | 252/132 |

OTHER PUBLICATIONS

M. S. Balsam-E. Sagarin, "Cosmetics Science and Technology", (p. 657) Wiley (1972).

Cosmetics: Science and Technology, Goulden et al., vol. 2, 2nd Ed., p. 144, Wiley-Interscience (1972).

*Primary Examiner*—Paul Lieberman

*Assistant Examiner*—John F. McNally

*Attorney, Agent, or Firm*—Frishauf, Holtz, Goodman & Woodward

[57] ABSTRACT

A menthol soap comprising a soap base, menthol, a crack-preventing agent, and a solvent for said menthol.

The menthol soap of the present invention gives a superior cold or refreshing feeling when applied on the skin. Furthermore, this menthol soap has such advantages that menthol crystals do not grow and come out to the surface of the soap during the storage of use thereof, and cracks do not develop in the soap.

11 Claims, No Drawings

MENTHOL SOAP

FIELD OF THE INVENTION

The present invention relates to menthol soap or soap compounded with menthol for the purpose of producing a cold or refreshing feeling in its use.

BACKGROUND OF THE INVENTION

The so-called menthol soap manufactured by compounding menthol to toilet soap for the purpose of producing a cold or refreshing feeling in its use has long been known. This menthol soap, however, has several disadvantages: for example, needle crystals of menthol grow and come out to the surface of the menthol soap during the storage or use thereof, and if the menthol soap is allowed to stand in a wet state after its use, cracks are formed therein. Conventional menthol soap, therefore, is hardly marketable, and it has been a continuing and significant subject for those engaged in the production of soap to overcome the above described disadvantages.

An attempt to add peppermint oil to a milled soap base has been made in recent years (see Japanese Patent Application Laid-Open No. 76100/1982). In this case, the amount of peppermint oil added is not more than 0.6% and is very small as a menthol content. Thus it fails to give a sufficiently satisfactory cold feeling on the skin. Furthermore, the process of producing such peppermint oil-compounded soap is very complicated and cannot be considered to be of high practical value.

When a milled soap is allowed to stand in a wet state after its use, there is a tendency for cracks to develop in the soap as it is dried. This will lead to a reduction in its product value. It is known, as described in Hans E. Tschakert, *Seifen-Ole-Fette-Wachse*, 83, Nr. 21, 610–612 and Nr. 22, 651–654 (1957), that such development of cracks in soap can be reduced by adding an oleyl alcohol/ethylene oxide adduct and a lauryl alcohol/ethylene oxide adduct to soap base.

With a further advance in the study to prevent the development of cracks in soap, it has been found that addition of surface active agents compatible with soap to soap base is effective for that purpose.

It may be considered, therefore, that marketable menthol soap can be produced by adding surface active agents as crack-preventing agents in combination with menthol to soap base. However, it has been revealed that the anticipated result cannot be realized; that is, although the development of cracks in soap can be reduced, the growth of menthol crystals in soap during the storage or use thereof cannot be prevented.

SUMMARY OF THE INVENTION

As a result of extensive investigations to develop menthol soap which is free from the above described disadvantages, it has been found that the object is attained by adding solvents for menthol in combination with menthol and crack-preventing agents to a soap base.

The present invention relates to a menthol soap comprising a soap base, menthol, a crack-preventing agent and a solvent for menthol.

DETAILED DESCRIPTION OF THE INVENTION

As the menthol as used herein, any of d-menthol, l-enthol, and dl-menthol can be used. Particularly preferred is l-menthol.

In view of the fact that menthol is added for the purpose of giving a cold or refreshing feeling when applied on to the skin, the amount of menthol compounded is suitable to range between 1 and 7% based on the weight of the soap stock. The most preferred results are obtained when menthol is added in an amount ranging between 2 and 3%. If the amount of menthol compounded is less than 1%, the desired effect can be obtained only insufficiently. On the other hand, if menthol is added in excess of 7%, it is inevitably necessary to increase the amounts of the solvent and crack-preventing agent being added. As a result, the resulting soap is softened as a whole and becomes difficult to produce. Furthermore, the gloss of the surface of soap is lost, resulting in a reduction of the product value.

Surface active agents compatible with soap are used as the crack-preventing agents. For example, higher alcohol/ethylene oxide adducts, alkanolamides of higher fatty acids, higher fatty acid alkanolamide/ethylene oxide adducts, polyethylene glycols, and polypropylene glycols can be used. Suitable examples of the above described surface active agents are ethylene oxide adducts of saturated or unsaturated higher alcohols containing 12 to 18 carbon atoms such as oleyl alcohol, cetyl alcohol, stearyl alcohol, and beef tallow alcohol. The amount of ethylene oxide added is preferably between about 10 and 50 moles. The amount of the crack-preventing agent compounded is appropriately between 1 and 7% based on the weight of the soap base, and it is usually proportional to the amount of menthol compounded. If the amount of the crack-preventing agent added is less than 1%, the object is attained only insufficiently. On the other hand, if it is in excess of 7%, the processability of the resulting soap is reduced.

Solvents for menthol are used for the purpose of preventing the crystal growth of menthol. It is required for the solvents to be capable of dissolving therein menthol and further to be compatible with a soap base and they sould not be volatile. It is preferred for them not to have a strong specific odour. Among the solvents satisfying the above described requirements are alkylene diols. Suitable examples are alkylene glycols having from 2 to 6 carbon atoms, such as ethylene glycol, propylene glycol, and hexylene glycol. It has been found experimentally, however, that esters such as diethyl phthalate, polyethylene glycols, and glycerines are unsuitable for use as solvents for menthol. The amount of the solvent added is appropriately about $\frac{1}{3}$ to 3/2 times that of menthol, with the range of $\frac{1}{2}$ to 1/1 being preferred. If the amount of the solvent is less than the lower limit, menthol crystals are dissolved in the solvent only insufficiently and thus it is not possible to sufficiently prevent the growth of the crystals. On the other hand, if the solvent is added in an amount exceeding the upper limit, various problems arise; for example, cracks are formed in the soap product, and the hardness of the soap product is not sufficiently high.

The soap base as used herein may be those commonly used in the production of milled soap. Examples of the soap base is sodium salts of fatty acid such as beef tallow, coconut oil, palm oil, etc.

In addition to the above described components, additives such as perfumes, dyes, presevatives, germicides, and the like may be added to the menthol soap of the invention as required.

The menthol soap of the invention can be produced by various procedures. Generally it is produced as follows. First, a crack-preventing agent is melted, and this molten crack-preventing agent is then added to and mixed with a soap base. Thereafter, a solvent with menthol dissolved therein is added thereto, and the resulting mixture is milled and extruded under pressure from an extruder, for example, in the form of bars. Finally the bar-shaped soap is cut to the desired length and stamped.

The process in which the components are added to the soap base is not critical. For example, the above described process may be reversed.

The menthol soap of the invention presents various advantages. For example, it gives a superior cold or refreshing feeling when applied on the skin; menthol crystals do not grow and come out to the surface of the soap during the storage or use thereof; and cracks do not develop in the soap. Hence the menthol soap of the invention has very high marketability as toilet soap.

The following examples are given to illustrate the invention in greater detail.

EXAMPLE 1

| | Amount (parts) |
|---|---|
| Milled soap base for toilet soap | 100 |
| Menthol JP | 2 |
| Crack-preventing agent (beef tallow alcohol/ethylene oxide adduct (ethylene oxide content: 25 moles), manufactured by Henkel Co. under the trade name of DEHYDOL TA 25) | 3 |
| Solvent for menthol (propylene glycol) | 2 |
| Titanium dioxide | 0.2 |
| Disodium ethylenediaminetetraacetate (EDTA-2Na) | 0.1 |

The crack-preventing agent was melted by heating, and added to and mixed with the soap stock. The solvent with menthol dissolved therein was added thereto and mixed. Then, titanium dioxide and EDTA-2Na were added, and the resulting mixture was subjected to rolling three times. Thereafter the mixture was extruded under pressure from a single stage simplex plodder to form a bar of soap. This bar was cut and stamped to the desired soap product.

This soap product was subjected to cracking and storage tests as described below.

Cracking Test

Menthol soap was immersed in water maintained at 20° C. for 4 hours. At the end of the time, the soap was taken out of the water and was allowed to stand for 36 hours by hanging in the room. Then, the formation of cracks in the soap was examined with the eye.

Storage Test

Menthol soap was immersed in water maintained at 20° C. for 6 hours. At the end of the time, the soap was taken out of the water and hung as such in the room. After 48 hours, the formation of cracks on the surface of the soap was examined with the eye. In this testing, to facilitate and ensure the determination, a 1% aqueous solution of *F.D. & C. Green No.* 3 was added to the soap in a proportion of 0.3%.

In the above prepared soap, neither cracks nor growth of needle crystals were observed. Furthermore, the processability (mold-separation) was good.

EXAMPLE 2

Menthol soap was produced in the same manner as in Example 1 except that the amounts of the menthol, crack-preventing agent, and solvent to be compounded were all changed to 5% based on the weight of the soap base.

This menthol soap was tested in the same manner as in Example 1. Neither cracks nor growth of needle crystals were observed.

EXAMPLE 3

Menthol soap was produced in the same manner as in Example 1 except that hexylene glycol was used as the solvent in place of propylene glycol.

In this menthol soap, cracks and growth of needle crystals were not observed at all. Furthermore the processability was good.

EXAMPLE 4

Menthol soap was produced in the same manner as in Example 1 except that the amount of the crack-preventing agent to be compounded was changed to 2% based on the weight of the soap base.

In this menthol soap, cracks and growth of needle crystals were not observed at all. Furthermore, the processability was very good.

COMPARATIVE EXAMPLE 1

Menthol soap was produced in the same manner as in Example 1 except that the crack-preventing agent and solvent were not added.

In this menthol soap, however, cracks developed and needle crystals of menthol were formed. Furthermore, the processability was inferior.

COMPARATIVE EXAMPLE 2

Menthol soap was produced in the same manner as in Comparative Example 1 except that the amount of menthol compounded was changed to 5% based on the weight of the soap base.

In this menthol soap, cracks and growth of needle crystals were observed. Furthermore, the processability was seriously inferior.

COMPARATIVE EXAMPLE 3

Menthol soap was produced in the same manner as in Example 1 except that the crack-preventing agent was not added.

In this menthol soap, cracks were formed, but growth of needle crystals was not observed. A slight amount of soap remained unremoved when it was removed from the mold.

COMPARATIVE EXAMPLE 4

Menthol soap was produced in the same manner as in Example 2 except that the crack-preventing agent was not added.

In this menthol soap, cracks were formed, but growth of needle crystals was not observed. A slight amount of soap remained unremoved when it was removed from the mold.

What is claimed is:

1. A menthol soap in bar form comprising a soap base, 2 to 7% by weight of menthol based on the weight of the soap base, 2 to 7% of a crack-preventing agent, and a solvent for said menthol in an amount of from $\frac{1}{3}$ to 3/2 that of the menthol;

said crack-preventing agent being a higher alcohol-/ethylene oxide adduct containing 10 to 50 moles of ethylene oxide per mole of alcohol and said higher alcohol being an alkyl or alkenyl $C_{12}$ to $C_{18}$ alcohol; and said solvent for said menthol being an alkylene diol having from 2 to 6 carbon atoms.

2. The menthol soap of claim 1, wherein said higher alcohol contains 14 to 18 carbon atoms.

3. the menthol soap of claim 2, wherein said higher alcohol is selected from the group consisting of oleyl alcohol, cetyl alcohol, stearyl alcohol and beef tallow alcohol.

4. The menthol soap of claim 3, wherein said alkylene diol is ethylene glycol, propylene glycol or hexylene glycol.

5. The menthol soap of claim 4, wherein said higher alcohol/ethylene oxide adduct is beef tallow alcohol-/ethylene oxide adduct.

6. The menthol soap of claim 5, wherein said alkylene diol is propylene glycol.

7. The menthol soap of claim 5, wherein said alkylene diol is hexylene glycol.

8. The menthol soap of claim 7 containing between 2 and 3% menthol.

9. The menthol soap of claim 4 containing between 2 and 3% menthol.

10. The menthol soap of claim 5 containing between 2 and 3% menthol.

11. The menthol soap of claim 6 containing between 2 and 3% menthol.

* * * * *